US006580206B2

(12) United States Patent
Van Nes et al.

(10) Patent No.: US 6,580,206 B2
(45) **Date of Patent: *Jun. 17, 2003**

(54) COLOR DISPLAY DEVICE WITH A DEFLECTION-DEPENDENT DISTANCE BETWEEN OUTER BEAMS

(75) Inventors: Johannes C. A. Van Nes, Eindhoven (NL); Daniel Den Engelsen, Eindhoven (NL); Albertus A. S. Sluyterman, Eindhoven (NL)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/218,550

(22) Filed: Dec. 22, 1998

(65) Prior Publication Data

US 2002/0057048 A1 May 16, 2002

(30) Foreign Application Priority Data

Dec. 29, 1997 (EP) ..... 97204128

(51) Int. Cl.[7] ..... H01J 29/51

(52) U.S. Cl. ..... 313/412; 313/426; 315/368.24; 315/368.11

(58) Field of Search ..... 313/412, 413, 313/414, 421, 426, 425, 428, 402; 315/368.11, 371, 368.26, 368.28, 368.24

(56) References Cited

U.S. PATENT DOCUMENTS

| | | | | | |
|---|---|---|---|---|---|
| 4,864,195 | A | * | 9/1989 | Masterton | 313/371 |
| 5,055,749 | A | * | 10/1991 | Chen et al. | 315/368 R |
| 5,170,101 | A | * | 12/1992 | Gorski et al. | 315/368.11 |
| 5,198,719 | A | * | 3/1993 | Koh | 313/414 |
| 5,248,920 | A | * | 9/1993 | Gioia et al. | 315/368.26 |
| 5,442,263 | A | * | 8/1995 | Alig | 315/382.1 |
| RE35,548 | E | * | 7/1997 | Sluyterman et al. | 315/368.28 |
| 5,936,338 | A | * | 8/1999 | Takahashi | 313/414 |
| 6,307,333 | B1 | * | 10/2001 | Sluyterman et al. | 313/402 |

FOREIGN PATENT DOCUMENTS

| | | | |
|---|---|---|---|
| EP | 0421523 A1 | 4/1991 | H01J/29/56 |

* cited by examiner

*Primary Examiner*—Ashok Patel
*Assistant Examiner*—Karabi Guharay

(57) ABSTRACT

A color display device having an electron gun, a display screen, a color selection electrode and a deflection unit. The distance between the electron beams in the x-direction is dynamically varied, whereby the distance in the deflection space decreases as the beams are deflected in at least one direction. The reduction of the distance enables the distance between the color selection electrode and the display screen to be increased in that direction. As a result, the curvature of the color selection electrode is increased, which has a positive effect on the strength and the doming and microphonic properties of the color selection electrode.

20 Claims, 7 Drawing Sheets

COLOR DISPLAY DEVICE WITH A DEFLECTION-DEPENDENT DISTANCE BETWEEN OUTER BEAMS

BACKGROUND OF THE INVENTION

The invention relates to a color display device comprising a color cathode ray tube including an in-line electron gun for generating three electron beams, a color selection electrode and a phosphor screen on an inner surface of a display window and a means for deflecting the electron beams across the color selection electrode.

Such display devices are known.

The aim is to make the outer surface of the display window flatter, so that the image represented by the color display device is perceived by the viewer as being flat. However, an increase of the radius of curvature of the outer surface will lead to an increase of a number of problems. The radius of curvature of the inner surface of the display window and of the color selection electrode should also increase, and, as the color selection electrode becomes flatter, the strength of the color selection electrode decreases and hence the sensitivity to doming and vibrations increases. An alternative solution to this problem would be to curve the inner surface of the display window more strongly than the outer surface. By virtue thereof, a shadow mask having a relatively small radius of curvature can be used. As a result, doming and vibration problems are reduced, however, other problems occur instead. The thickness of the display window is much smaller in the center than at the edges. As a result, the weight of the display window increases and the intensity of the image decreases substantially towards the edges.

BRIEF SUMMARY OF THE INVENTION

It is an object of the invention to provide a color cathode ray tube of the type mentioned in the opening paragraph, in which the outer surface may be flat or almost flat, while, at the same time, the above problems are overcome or reduced.

To achieve this, a color display device in accordance with the invention is characterized in that the color display device comprises a first and a second means, which are arranged at some distance from each other to dynamically influence the trajectories of the electron beams, to decrease the distance between the electron beams at the location of the deflection plane as a function of the deflection in at least one deflection direction.

The color display device in accordance with the invention has a first and a second means, arranged at some distance from each other, for dynamically influencing the trajectories of the electron beams. By virtue thereof, the distance between the electron beams (also referred to as "pitch") in the plane of deflection can be changed dynamically in such a manner that this distance decreases as the deflection increases. By dynamically changing this distance, as a function of the deflection, and hence as a function of the x and/or y-coordinate(s), the distance between the display window and the color selection electrode can increase accordingly in the relevant deflection direction. The shape of the inner surface of the display window and the distance between the display window and the color selection electrode determine the shape, in particular the curvature, of the color selection electrode. Since the distance between the electron beams decreases as a function of the deflection, the distance between the display window and the color selection electrode increases and the shape of the color selection electrode can deviate more from the shape of the inner surface of the display window than in known cathode ray tubes, and, in particular, its curvature can be greater. Said greater curvature (in other words, a smaller radius of curvature) increases the strength of the color selection electrode and reduces doming and microphonics.

Preferably, the first means is integrated in the electron gun, that is, the first means comprises one or more components of the electron gun.

In comparison with a separate first means, this has the advantage that fewer components are necessary and that the distance between the first and the second means is increased, thus enabling an increase of the possible variation in distance between the electron beams and hence of the variation in distance between the color selection electrode and the display screen and, consequently, a greater change in curvature of the color selection electrode.

Preferably, the first means comprises one or more components of the prefocusing portion of the electron gun. As a result, the distance between the first and the second means is increased, compared to embodiments in which the first means is situated at the location of, for example, the main lens portion, thus enabling an increase of the possible variation in distance between the electron beams and hence of the variation in distance between the color selection electrode and the display screen.

Alternatively, in embodiments a separate first means is used. The advantage of using a separate first means is that the electron gun design need not be changed. Since the electron gun design need not be changed, the electron-optical functions of the electron gun such as the generation, beam forming and focusing of the electron beams are not or hardly affected by the introduction of the first means, and application of a separate first means is much easier. Preferably the separate first means are situated on the outside of the envelope. The means are then easily accessible, and current can easily be supplied.

Preferably, the second means is integrated in the deflection means, that is, the second means comprises one or more components of the deflection means.

This has the advantage, compared to a separate second means, that fewer components are necessary and that the distance between the first and the second means is increased, thus enabling an increase of the possible variation in distance between the electron beams and hence of the variation in distance between the color selection electrode and the display screen.

Preferably, the distance between the electron beams as a function of the deflection varies at least 2%. As a result, the radius of curvature of the color selection electrode can change so much that a noticeable change in doming and microphonic properties is achieved. In a further preferred embodiment, the distance between the outer beams varies more than 5%. This enables a greater change in radius of curvature to be achieved, which has a strong influence on doming and microphonic properties.

These and other objects of the invention will be apparent from and elucidated with reference to the embodiments described hereinafter.

DETAILED DESCRIPTION OF THE INVENTION

Figure 1:
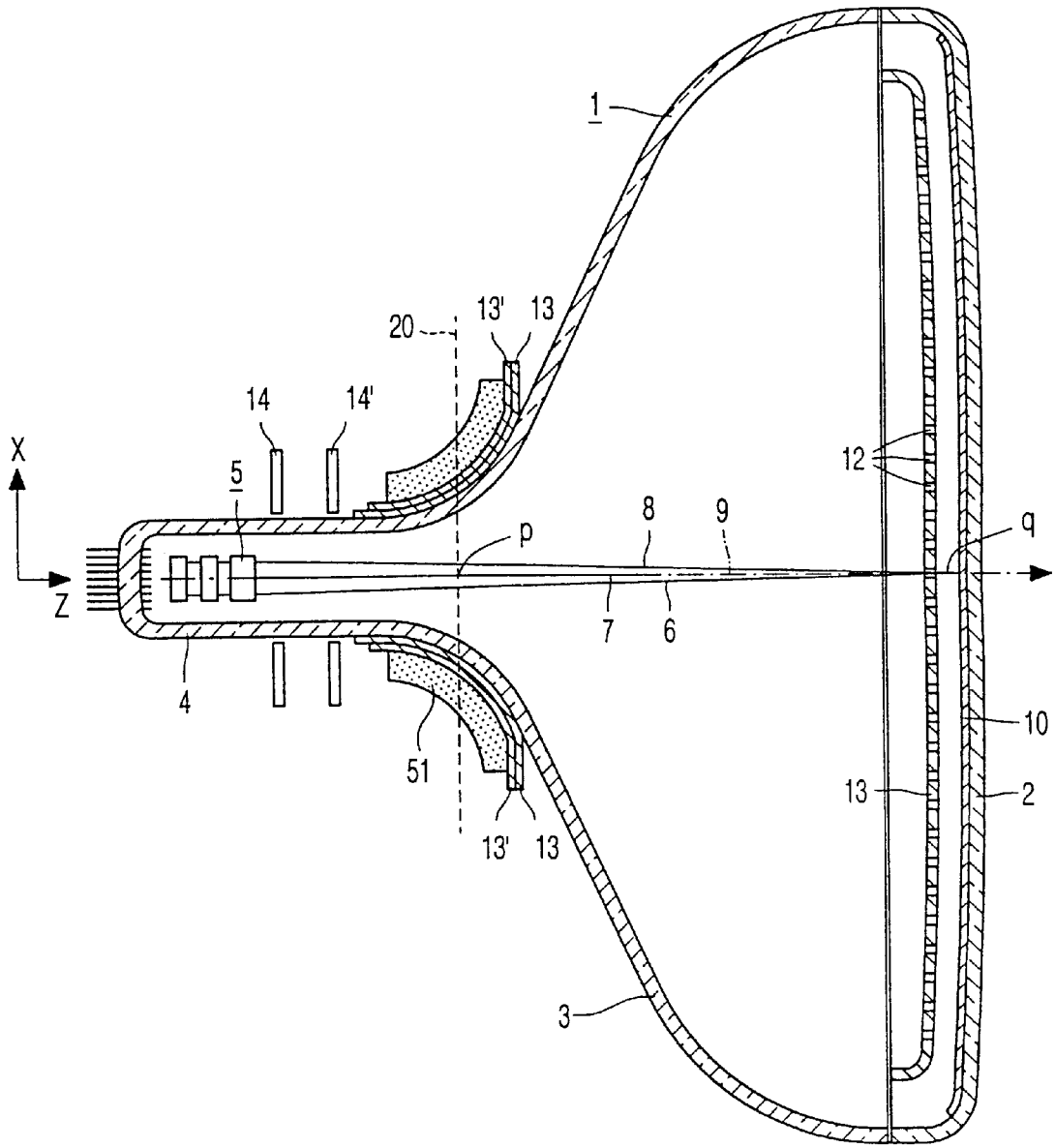
FIG. 1 is a sectional view of a display device, in which the invention is schematically shown.

The Figures are not drawn to scale. In the Figures, like reference numerals generally refer to like parts.

The display device comprises a cathode ray tube, in this example a color display tube, having an evacuated envelope 1 which includes a display window 2, a cone portion 3 and a neck 4. In the neck 4, there is arranged an electron gun 5 for generating three electron beams 6, 7 and 8 which extend in one plane, the in-line plane, which in this case is the plane of the drawing. In the undeflected state, the central electron beam 7 substantially coincides with the tube axis 9. The inner surface of the display window is provided with a display screen 10. Said display screen 10 comprises a large number of phosphor elements luminescing in red, green and blue. On their way to the display screen, the electron beams are deflected across the display screen 10 by means of an electromagnetic deflection unit 51 and pass through a color selection electrode 11 which is arranged in front of the display window 2 and which comprises a thin plate having apertures 12. The three electron beams 6, 7 and 8 pass through the aperture 12 of the color selection electrode at a small angle relative to each other and hence each electron beam impinges only on phosphor elements of one color. The deflection unit 51 comprises, in addition to a coil holder 13, coils 13' for deflecting the electron beams in two mutually perpendicular directions. The display device further includes means for generating voltages which, during operation, are fed to components of the electron gun via feedthroughs. The deflection plane 20 is schematically indicated as well as the distance p between the electron beams 6 and 8 in this plane, and the distance q between the color selection electrode and the display screen.

Figure 2A:
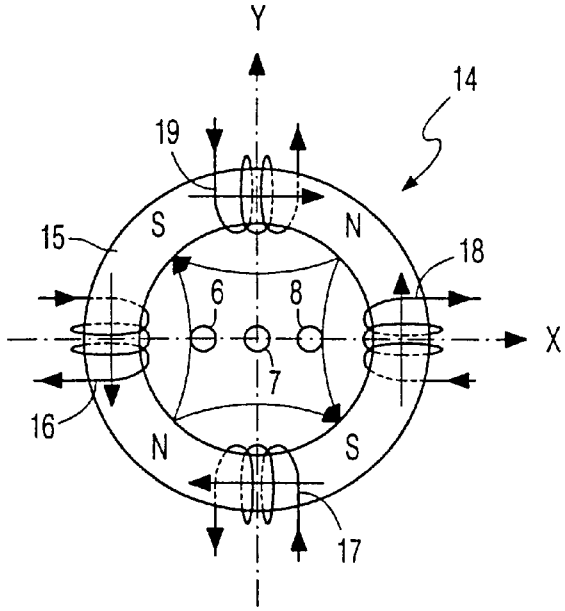
FIGS. 2A, 2B schematically show a number of quadruple elements.
Figure 2B:
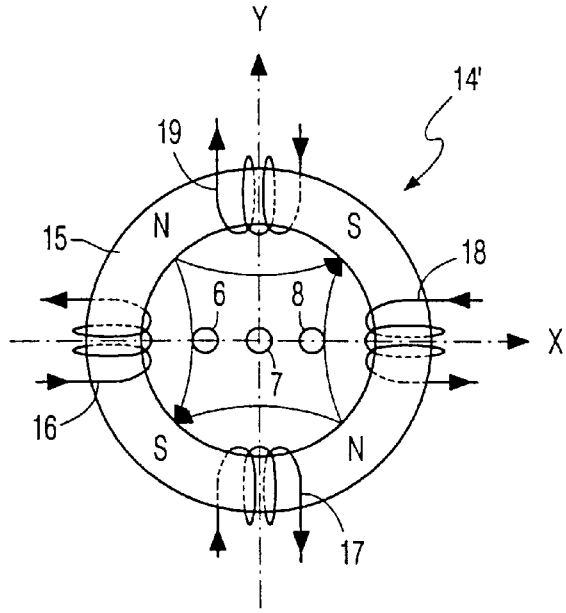
Figure 6:
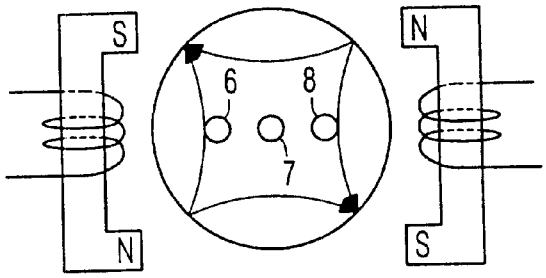
FIGS. 6 and 7 show alternative embodiments of quadruple elements.
Figure 7:
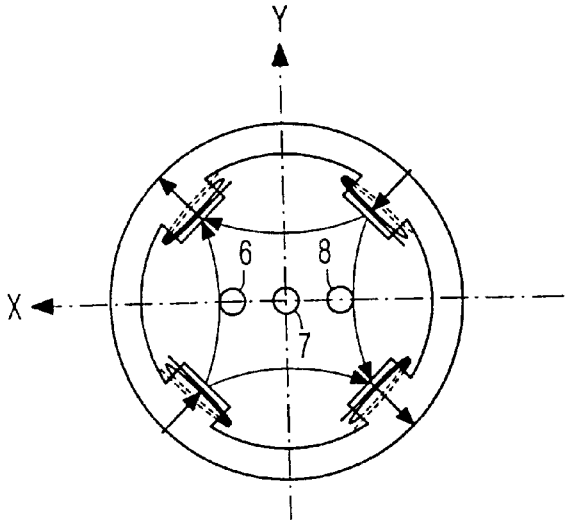

The color display device comprises two means 14, 14', whereby a first means 14 is used, in operation, to dynamically bend, i.e. as a function of the deflection in a direction, the outermost electron beams towards each other, and a second means 14' which serves to dynamically bend the outermost electron beams in opposite directions. FIGS. 2A and 2B show examples of such means. In this case, means 14 (FIG. 2A) comprises a ring core of a magnetizable material on which four coils 16, 17, 18 and 19 are wound in such a manner that, upon excitation (using, for example, a current which is proportional to the square of the line deflection current), a 45° quadrupole field is generated. A 45° quadrupole field can alternatively be generated by means of two wound C-cores, as shown in FIG. 6, or by means of a stator construction as shown in FIG. 7. The construction of means 14' (FIG. 2B) is comparable to that of means 14. However, the coils are wound in such a manner, and the direction in which, in operation, current passes through the coils is such that a 45° 4-pole field is generated having an orientation which is opposite to that of the 45° field shown in FIG. 2A.

FIG. 1 schematically shows the invention. The three electron beams 6, 7 and 8 are separated from each other in the plane of deflection (a plane 20 which is situated approximately in the center of the deflection unit (51) by a distance p. The distance q between the color selection electrode 12 and the display screen 10 is inversely proportional to the distance p. In a formula, this can be expressed as follows:

$$q=Cp^{-1},$$

where C is a constant.

The color display device in accordance with the invention comprises two means (14, 14'), which are positioned at some distance from each other, and which are used to vary the distance p in the x-direction, as a function of the deflection, in such a manner that this distance p decreases as a function of the deflection in at least one direction.

Preferably, the means can suitably be used to dynamically vary the distance p in the x-direction between the electron beams as a result of deflection in at least the y-direction. The advantage resulting from a flatter construction of the display window is largest in the y-direction.

Figure 3:
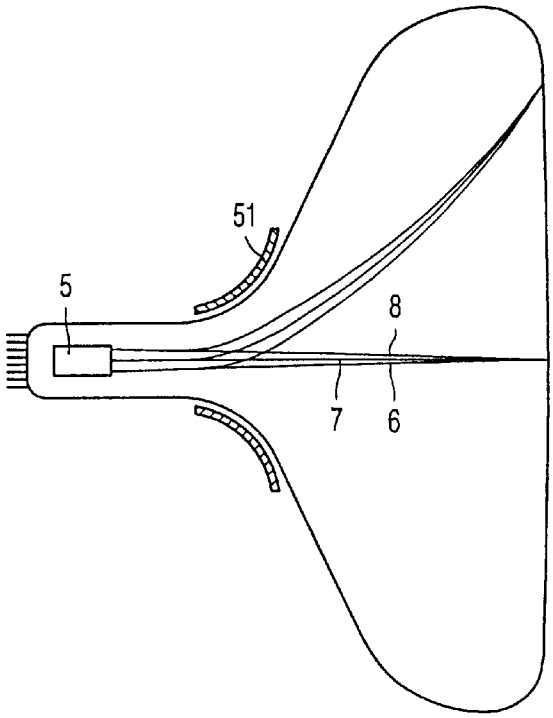
FIGS. 3 and 4 show, by means of schematic, sectional views of color display devices, a number of recognitions on which the invention is based.
Figure 4:
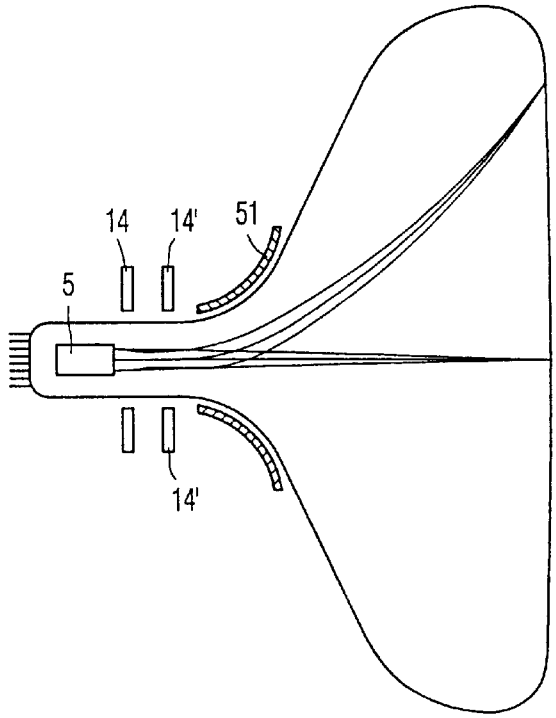

This effect is illustrated in FIGS. 3 and 4. FIG. 3 shows a color display device without the means 14, 14'. The distance between the electron beams at the location of the deflection unit 51 does not change as a function of the deflection. In FIG. 4, the means 14, 14' do change this distance, i.e. the means 14 bends the electron beams towards each other, and the means 14' bends the electron beams in opposite directions. As a result, the distance between the electron beams is smaller for deflected electron beams than for undeflected electron beams. Since the distance p is smaller, the distance q may increase. The increase of the distance q leads to an increase of the curvature of the color selection electrode. This has a positive effect on the strength of the color selection electrode, while doming and microphonics decrease.

Figure 5:
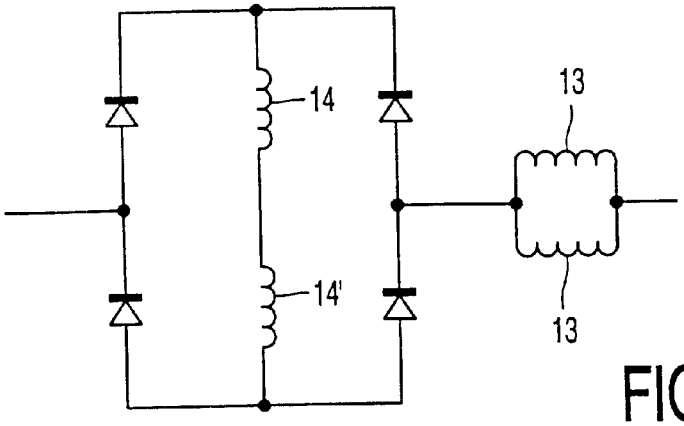
FIG. 5 shows an example of interconnecting quadruple elements in a circuit.

FIG. 5 shows, with reference to an example, how the means 14 and 14' can be incorporated in a circuit having line deflection coils 13.

FIGS. 1 through 7 show embodiments in which the color display device comprises two means 14, 14' which are situated between the gun 5 and the deflection unit 51.

In accordance with a first alternative, the means 14' is integrated in the deflection unit either by winding a separate coil onto the deflection unit to generate a dynamic electromagnetic 4-pole field or by modifying the windings of an existing deflection coil in such a manner that the deflection coils generate a dynamic electromagnetic 4-pole field. Within the concept of the invention there also are embodiments in which a separate quadrupole in front of the deflection unit is combined with a non/selfconvergent deflection unit, i.e. a deflection unit which generates a deflection field which is non-selfconvergent (in fact over-selfconverging)

In accordance with another alternative, the means 14 is integrated in the electron gun 5. By applying dynamic voltage differences between two or more apertures in subsequent electrodes, the center line of the apertures in these electrodes being displaced relative to each other, an electric field can be applied which comprises a component at right angles to the direction of movement of the electron beams (in the x-direction), so that the beams are moved towards each other. The integration of the means 14 in the electron gun has the advantage that the distance between the first means 14 and the second means 14' is increased, thus enabling a greater dynamic change in the distance p and hence a greater change in the distance q from the center to the edge. The means may be integrated in or right in front of a main lens portion. In an example, the distance between the outermost apertures in the first main lens electrode is smaller than the distance in the second main lens electrode (also referred to as anode). Between the main lens electrodes a voltage is applied which comprises a dynamic component. By virtue thereof, the electron beams can be made to move towards each other (converge) in the main lens; the dynamic component in the voltage between the main lens electrodes causes a dynamic change of the convergence. A similar effect can be brought about between sub-electrodes of the main lens portion of the electron gun. In these embodiments, the means 14' is a separate quadruple-generating element as shown in FIGS. 1 through 7 or, preferably, it is integrated in the deflection unit to maximize the distance between the means 14 and 14'. Preferably, the means 14 is integrated in the prefocusing portion of the electron gun, for example by displacing outermost apertures in the G2 and G3 electrodes relative to each other and applying a dynamic component-containing potential difference between the electrodes. As a result of the relative displacement of the apertures in the electrodes, the electric field generated, in operation, between the electrodes comprises a component transverse to the direction of propagation of the outermost electrodes, so that the convergence of the electron beams is influenced. The dynamic component in the voltage applied between the electrodes causes a dynamic adaptation of the convergence, whereby, in this embodiment of the prefocusing part of gun invention, in this part the beams are moved towards each other as a function of the deflection. Such a means 14 can be combined with a means 14', as shown in FIGS. 1 through 7, or with a means 14' integrated in the deflection unit 51. This has the advantage that there is a large distance between the means 14 and 14'. A result of the fact that the convergence of the beams in the prefocusing portion is changed dynamically is that the position of the outermost electron beams in the main lens is also subject to a dynamic variation. This change will also cause a change of the direction of the electron beams, which generally results in the electron beams moving in opposite directions. The second means 14' may be constituted by the main lens per se, to which a dynamic voltage is applied or not.

Figure 4A:
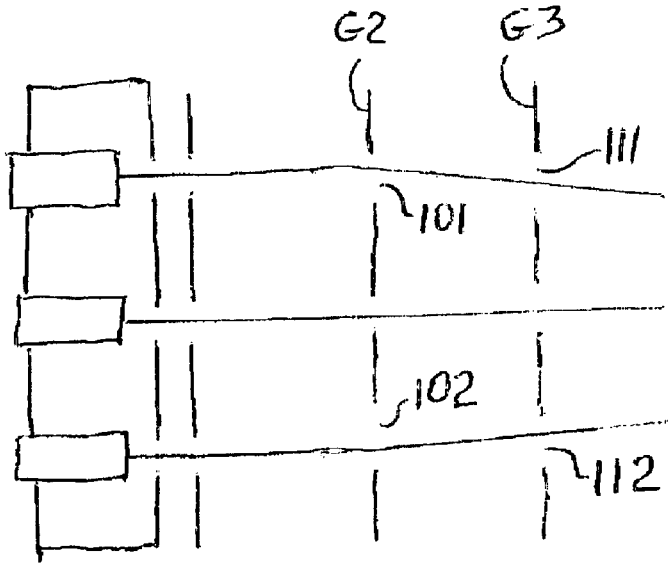
FIGS. 4A and 4B show diagrammatically dynamic beam bending elements integrated in an electron gun according to the invention, in the prefocusing portion, and the main lens portion respectively.
Figure 4B:
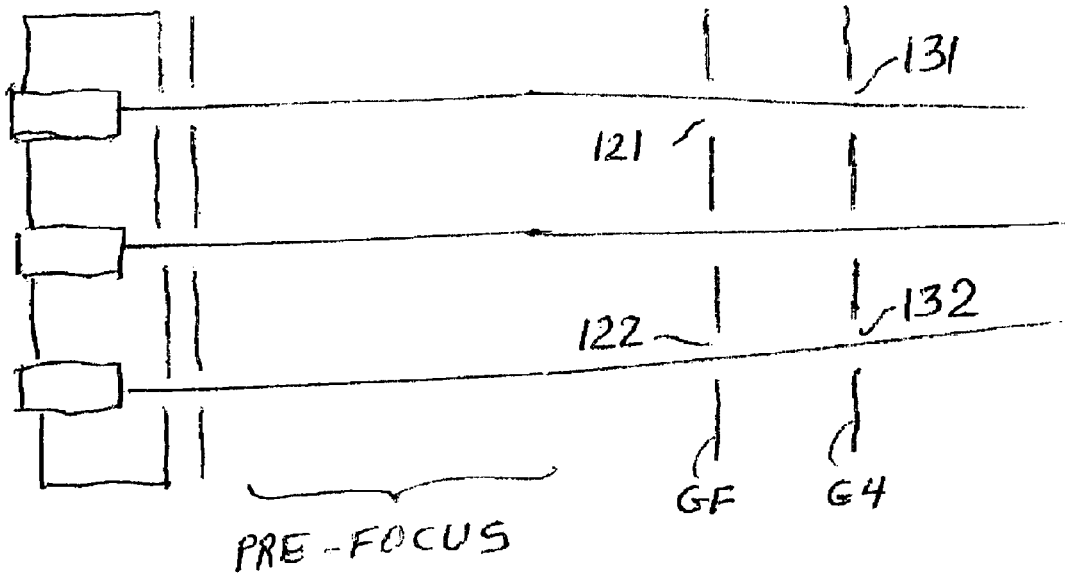

FIG. 4A shows diagrammatically a prefocusing portion of an electron gun. The outermost apertures 101, 102 and 111, 112 of grids G2 and G3 are displaced toward each other. FIG. 4B shows diagrammatically a main lens portion of an electron gun. The outermost apertures 121, 122 of the first main lens electrode GF are displaced toward each other compared with the outermost apertures 131, 132 of the second main lens electrode G4.

The invention can briefly be summarized as follows: a color display device comprises an electron gun, a display screen and a color selection electrode as well as a deflection means. The distance between the electron beams is dynamically varied, i.e. the distance in the deflection space decreases as the beams are deflected in at least one direction. The reduction of the distance enables the distance between the color selection electrode and the display screen to be increased in that direction. As a result, the curvature of the color selection electrode is increased, which has a positive effect on the strength and the doming and microphonic properties of the color selection electrode. It is remarked that the expression "to decrease the distance between the electron beams at the location of the deflection plane as a function of the deflection" is to be understood to mean that, due to the action of the first and second means, as a function of deflection, i.e. when the deflection angle increases, the distance decreases. In some embodiments, the total effect to the means in operation could, when the beams are non-deflected, for a part or the whole of the deflection be such that the distance between the beams is increased in respect of a situation in which the means are non-operative.

It will be obvious that within the scope of the invention many variations are possible to those skilled in the art.

Preferably, the change of the distance q as a result of the dynamic change of the distance p, is more than 1.5 mm, measured from the center to the upper side or lower side (that is in the y-direction).

For a better understanding of the invention some principles of aspects of the invention are described below and illustrated by FIGS. 8 and 9.

Real flat CRT's have recently been introduced in the market. When the display window (sometimes also called 'the panel') becomes flatter, the shadow mask also has to be made flatter. By doing so the mask becomes more sensitive for doming (causing discoloration of the image) and drop test (causing buckling of the mask). A way to escape from this deadlock is keeping the shadow mask curved (with a large radius of curvature, e.g. 3R) and making a curved inner surface of the display window. When the curvature of the inner surface of the display window is still substantial and the outer surface is flat, then the plane gets a large glass wedge (large increase in thickness of the display window going from the centre of the display window to the edges of the display window). The large glass wedge has a negative impact on the luminance distribution of the image when dark glass is used, and moreover, a large wedge affects the speed of thermal processing of the CRT as well as the weight of the CRT.

A color display device in accordance with the invention enables a fairly small tube weight and a small glass wedge, e.g. only 10 mm. In FIG. 8 the principle of the invention is schematically shown: by means of two quadrupoles (Q1 and Q2) the mask-screen distance in the vertical direction can be modulated. In this way a larger curvature of the mask can be obtained. The invention can in particular be applied in conjunction with the double mussel coil technology. In the example shown in FIG. 8 the second quadrupole Q2 is integrated with the frame deflection unit. It can be integrated in the frame coil or wound as a separate coil in a toroidal form around the core of the deflection unit. The invention allows a substantially flat inner surface of the display window (e.g. radii of curvature of more than 5 meters, for instance 7.2 meters) to be combined with a shadow mask which is substantially more curved, e.g. having radii of curvature below 5 meters, for instance a radius of curvature of 3.9 meters (horizontally) and 1.9 meters vertically.

As the dimensions above show, the inventions allows the use of a CRT where the radius of curvature of the color selection electrode is less than approximately 70% of the radius of curvature of the inner surface of the display window, for example where the color selection electrode has a radius of curvature in the x-direction approximately 54% of the window inner surface radius of curvature, and a radius of curvature in the y-direction approximately 26% of the window inner surface radius of curvature.

Figure 9:
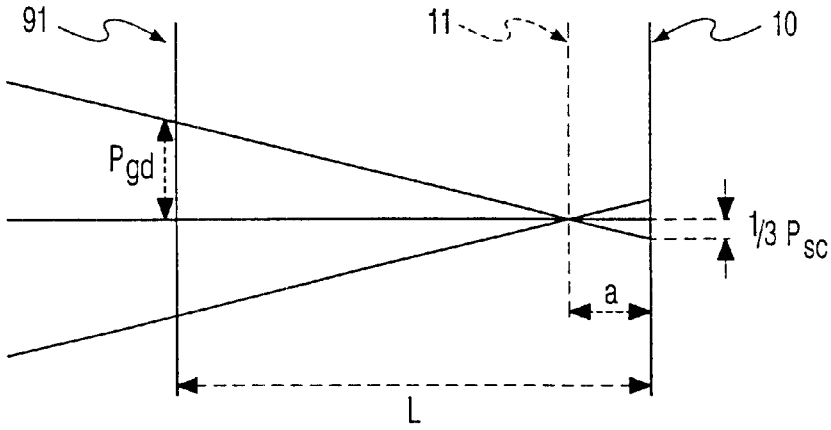

FIG. 9 shows the relation between the gun pitch $P_{gd}$ (i.e. the distance between the central and outer beams at the deflection plane 91 of the deflection unit), the screen pitch $P_{sc}$ (i.e. the distance between the central and outer beams at the screen 10), the distance L between the deflection plane and the screen, and the distance q between the shadow mask and the screen. The three beams 6, 7, 8 as they leave the gun, are converged on the screen 10. FIG. 9 shows that for a given screen pitch $P_{sc}$ and a given distance L, the distance q increases when the gun pitch $P_{gd}$, decreases. Mathematically this relation is given by:

$$q=(P_{sc}*L)/(3*P_{gb}+P_{sc}).$$

So in the invention, by varying the gun pitch as a function of deflection, the mask to screen distance q can be varied for each point on the screen and additional mask curvature can be obtained.

Figure 8:
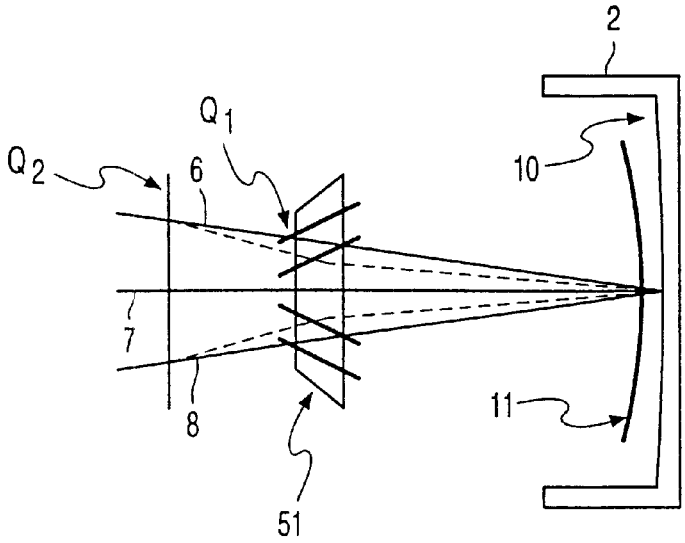
FIGS. 8 and 9 illustrate some aspects of the invention.
Figure 10:
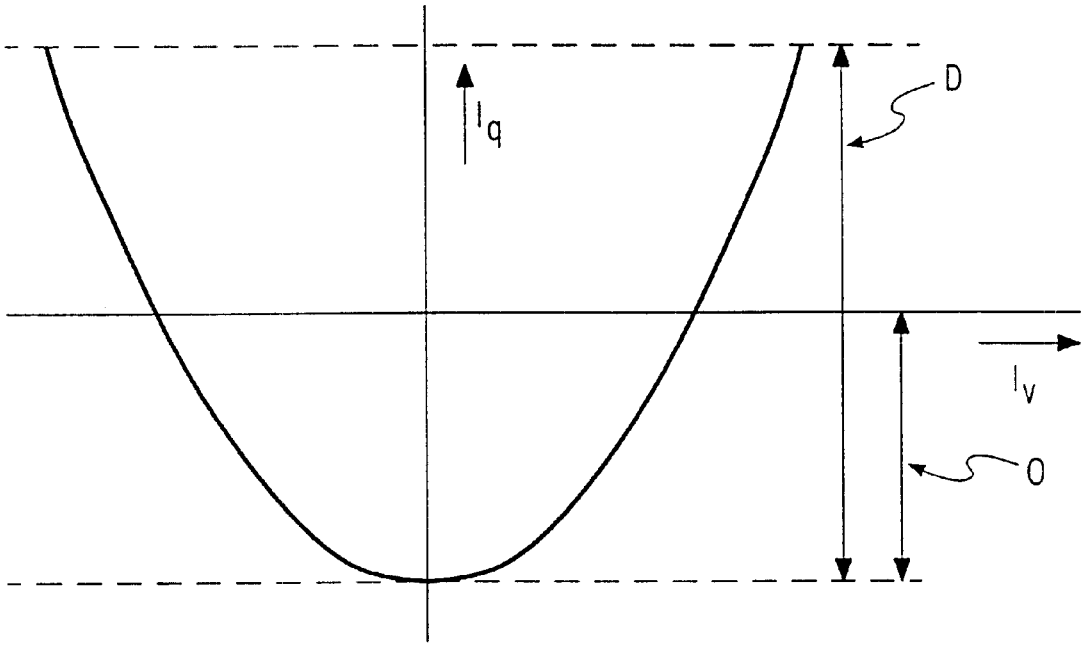
FIG. 10 schematically illustrates a driving scheme for the quadrupoles.

FIG. 10 illustrates schematically the current applied to the two quadrupoles shown in FIG. 8. Quadrupole 2, which is located near or around the electron gun, is used to optimise the colour purity performance of the tube. Quadrupole 1 is used to restore the convergence performance. Because quadrupole 1 is located close to the horizontal deflection plane of the deflection unit, it has little influence on colour purity. This simplifies deflection unit-to-cathode ray tube matching, which is done in CRT manufacturing plants. Because the impact of each of the quadrupoles is significant, reliable driving of the quadrupoles is an important aspect. In that respect "current driving" rather than "voltage driving" is preferred, and preferably frame (vertical)-deflection dependent currents are supplied to the quadrupoles. In a simple and preferred driving scheme the quadrupole drive current is substantially proportional to the square of the vertical deflection current with a negative offset of approximately half the nominal dynamic amplitude. This is schematically shown in FIG. 10, in which the current supplied to the quadrupoles ($I_q$) is given as a function of the vertical deflection current ($I_v$). The negative offset O is approximately half the Dynamic Amplitude D. This driving scheme (i.e. O is approximately half D) has the advantage that the offset does not depend on the amount of overscan chosen for a particular set, which enables the drive circuit for the quadrupoles to be integrated into the deflection unit. It is to be noted that in this particular embodiment, the distance between the electron beams decreases as $I_q$ increases. This means however also, that for the undeflected beams i.e. $I_v$=0) and even for an important part of the deflection the current Iq is negative and, and is such that the distance between the electron beams is in fact larger than for $I_q$=0, i.e. when the quadrupoles are non-operative.

What is claimed is:

1. A color display device comprising a color cathode ray tube including:

an in-line electron gun having an electron lens portion, for generating three electron beams which define a plane, a color selection electrode, a phosphor screen on an inner surface of a display window, means for deflecting the electron beams across the color selection electrode in an x-direction substantially parallel to said plane and a y-direction substantially perpendicular to said plane, said means for deflecting defining a deflection plane, and means for dynamically influencing the convergence of the electron beams by decreasing the distance between the electron beams in the x-direction at the location of the deflection plane as a function of the deflection in one deflection direction, said means for dynamically influencing comprising first means and second means which are spaced axially from each other, characterized in that said one deflection direction is the y-direction, and said means for deflecting is disposed axially between said first means and said color selection electrode.

2. The color display device claimed in claim 1, characterized in that said second means is integrated in the deflection means, said second means comprising one or more components of the deflection means.

3. The color display device claimed in claim 1, characterized in that the distance between the electron beams, as a function of the deflection, varies at least 2%.

4. The color display device claimed in claim 3, characterized in that the distance between the electron beams, as a function of the deflection, varies at least 5%.

5. The color display device claimed in claim 4, characterized in that said first means is integrated in the electron gun.

6. The color display device claimed in claim 5, wherein the inner surface of the display window has a given radius of curvature in the y-direction, characterized in that the color selection electrode has a radius of curvature in the y-direction less than approximately 70% of said given radius of curvature.

7. The color display device claimed in clam 5, characterized in that said means for dynamically influencing decreases said distance as a function of deflection in the x-direction also.

8. The color display device claimed in claim 7, wherein the inner surface of the display window has a given radius of curvature, characterized in that the color selection electrode has a radius of curvature in the x-direction approximately 54% of said given radius of curvature, and a radius of curvature in the y-direction approximately 26% of said given radius of curvature.

9. A color display device comprising a color cathode ray tube including:

an in-line electron gun having an electron lens portion, for generating three electron beams which define a plane, said electron lens portion comprising a prefocusing portion and a main lens portion, a color selection electrode, a phosphor screen on an inner surface of a display window, means for deflecting the electron beams across the color selection electrode in an x-direction substantially parallel to said plane and a y-direction substantially perpendicular to said plane, said means for deflecting defining a deflection plane, and means for dynamically influencing the convergence of the electron beams by decreasing the distance between the electron beams at the location of the deflection plane as a function of the deflection in at least one deflection direction, said means for dynamically influencing comprising first means and second means which are spaced axially from each other, characterized in that said first means comprises one or more components of the prefocusing portion of the electron gun.

10. The color display device claimed in claim 9, characterized in that said second means is integrated in the deflection means, said second means comprising one or more components of the deflection means.

11. The color display device claimed in claim 9, characterized in that said at least one direction is the y-direction.

12. The color display device claimed in claim 11, characterized in that the distance between the electron beams, as a function of the deflection, varies at least 5%.

13. The color display device claimed in claim 11, wherein the inner surface of the display window has a given radius of curvature in the y-direction, characterized in that the color selection electrode has a radius of curvature in the y-direction less than approximately 70% of said given radius of curvature.

14. The color display device claimed in claim 11, characterized in that said means for dynamically influencing decreases said distance as a function of deflection in the x-direction also.

15. The color display device claimed in claim 14, wherein the inner surface of the display window has a given radius of curvature, characterized in that the color selection electrode has a radius of curvature in the x-direction approximately 54% of said given radius of curvature, and a radius of curvature in the y-direction approximately 26% of said given radius of curvature.

16. A color display device comprising a color cathode ray tube including:

an in-line electron gun having an electron lens portion, for generating three electron beams which define a plane, said electron lens portion comprising a prefocusing portion and a main lens portion, a color selection electrode, a phosphor screen on an inner surface of a display window, means for deflecting the electron beams across the color selection electrode in an x-direction substantially parallel to said plane and a y-direction substantially perpendicular to said plane, said means for deflecting defining a deflection plane, and means for dynamically influencing the convergence of the electron beams by decreasing the distance between the electron beams at the location of the deflection plane as a function of the deflection in one deflection direction, said means for dynamically influencing comprising first means and second means which are spaced axially from each other, characterized in that said first means comprises one or more components of the main lens portion of the electron gun.

17. The color display device claimed in claim 16, characterized in that said second means is integrated in the deflection means, said second means comprising one or more components of the deflection means.

18. The color display device claimed in claim 16, characterized in that said at least one direction is the y-direction.

19. The color display device claimed in claim 16, wherein the inner surface of the display window has a given radius of curvature in the y-direction, characterized in that the color selection electrode has a radius of curvature in the y-direction less than approximately 70% of said given radius of curvature.

20. The color display device claimed in claim 16, wherein the inner surface of the display window has a given radius of curvature, characterized in that said means for dynamically influencing decreases said distance as a function of deflection in the x-direction also.

* * * * *